United States Patent [19]

Robertson et al.

[11] Patent Number: 5,064,354

[45] Date of Patent: Nov. 12, 1991

[54] HIGH PRESSURE FLUID PUMP

[76] Inventors: Walter W. Robertson, 8415 Old State Rd., Cranesville, Pa. 16410; Jason L. Robertson, 13150 Fry Rd., Edinboro, Pa. 16412

[21] Appl. No.: 532,457

[22] Filed: Jun. 4, 1990

[51] Int. Cl.[5] ..... F04B 21/08; F04B 39/14

[52] U.S. Cl. ..... 417/403; 417/454; 417/567; 417/569; 417/571; 92/128

[58] Field of Search ..... 417/454, 360, 403, 567, 417/569, 571; 92/117 R, 128

[56] References Cited

U.S. PATENT DOCUMENTS

| | | | |
|---|---|---|---|
| 1,729,430 | 9/1929 | Machtolf . | |
| 2,991,003 | 7/1961 | Petersen | 230/53 |
| 3,309,014 | 3/1967 | Bauer et al. | 417/571 |
| 3,508,849 | 4/1970 | Weber | 417/454 |
| 3,771,912 | 11/1973 | Conlee | 417/397 |
| 4,371,001 | 2/1983 | Olson | 137/512.3 |
| 4,382,750 | 5/1983 | Robertson | 417/397 |
| 4,412,792 | 11/1983 | LaBorde et al. | 417/571 |
| 4,756,512 | 7/1988 | Toms, Jr. | 92/128 |
| 4,780,064 | 10/1988 | Olsen | 417/397 |
| 4,878,815 | 11/1989 | Stachowiak | 417/454 |

*Primary Examiner*—Richard A. Bertsch
*Assistant Examiner*—Michael I. Kocharov
*Attorney, Agent, or Firm*—Buchanan Ingersoll

[57] ABSTRACT

An improved high pressure, piston pump has at least one two-piece telescoping cylinder having an end flange at one end and a housing containing piston drive means at the other end which are held together by tie rods passing through spacer tubes. The cylinder can be opened without loosening the tie rods to expose the piston and replace the piston seal.

15 Claims, 3 Drawing Sheets

HIGH PRESSURE FLUID PUMP

BACKGROUND OF THE INVENTION

The invention relates to a high pressure pump for gas or liquid which is easy to service because the pump cylinder can be retracted to expose the piston for removal and replacement of the packing.

FIELD OF THE INVENTION

One type of high pressure pump commonly used contains at least one cylinder having an end flange at one end and a housing at the opposite end which are held together by tie rods. Within the housing a means is provided for reciprocating a piston within the cylinder. A packing is provided either on the cylinder or on the piston. The packing wears during operation and must be replaced. In order to replace the packing one must open the cylinder. To do so, it is necessary to loosen the tie rods and remove the end flange. After the cylinder is open the piston can be removed and the packing replaced. Then, one must reverse the process to reassemble the pump.

One example of a resolution to this problem is shown in U.S. Pat. No. 4,382,750. In this pump, there is a free piston which is accessed through a threaded plug in the cylinder head or end flange permitting removal for repair or replacement of the piston for service. Although a considerable improvement over tie-rod removal and replacement for seal access, this method requires removal of the fluid inlet and outlet piping and further requires that a sufficient inlet pressure exists to overcome piston friction during the suction stroke so that the piston is held against the piston rod, assuring complete cylinder refilling. Such a procedure is still quite cumbersome and sufficiently high inlet pressures are often unavailable. This invention overcomes both these shortcomings, and satisfies a need for a pump in which the seals can be replaced without requiring this disassembly or high inlet pressure.

Within the end flange there commonly is a check valve assembly having both an inlet and discharge check valve to allow flow into and out of the pump cylinder. One common practice is to join the passageway of each valve into a common passageway into the pump cylinder. The intersection of these two passageways form a T-configuration. This configuration, however, is quite subject to fatigue failure caused by stress concentrations at the intersecting bores of the T. Unwanted stress concentrations have been to a considerable extent avoided by the use of a configuration in which the check valves are separate or coaxial with respect to the inlet and outlet passage. Such configuration is proposed in Olsen's U.S. Pat. No. 4,371,001. High pressure is prevented access to the intersecting inlet passageway by the inlet check valve poppet and the outlet check valve passageway is separate and does not intersect the inlet passageway. This method, however, requires orientation of the check valve poppet and does not allow random seating orientation of the inlet poppet to the valve seat. This enhances fretting and wear and prevents healing of seat or poppet damage through random orientation during seating or closing. Further, the high-pressure passageway is eccentric to the check valve body thus causing an unsymmetrical and higher stress pattern in the body. The method is complex and requires many parts. Although the check valve can be more easily repaired than those proceeding it, there still remains a need for a check valve assembly which does not require eccentric ports or passageways, does not have intersecting pressurized passageways, has the economy of few parts, is even easier to repair and is suited for uses in high pressure pumps.

SUMMARY OF THE INVENTION

We provide an improved high pressure fluid pump of the type having a piston which contains a seal near one end. We further provide a cylinder through which the piston reciprocates that is of two piece construction having a housing and a pump cylinder. The pump cylinder is sized and configured to telescope into the housing. With this configuration, the pump cylinder can be removably attached by light weight screws to the end flange. When the seal wears, we can remove those screws and telescope the pump cylinder into the housing. Then the end of the piston containing the seal will be exposed so that the seal can be easily removed and replaced.

We further provide a concentric check valve having a central bore with a poppet guide inserted therein. The guide is threaded into or otherwise attached to the discharge poppet on its end fartherst from the end flange. The opposite end of the guide accepts the inlet poppet which is provided with a central hub and bore for this purpose. The end of the guide nearest the end flange is also threaded and a single spring is installed around this end of the guide. One end of the spring rests against the inlet poppet and the other end against a nut or retainer threaded onto the guide. This spring biases both the inlet and discharge poppet against their respective seats. As the pump piston is withdrawn from the pump cylinder during the suction stroke, inlet fluid pressure against the inlet poppet compresses the spring and allows passage of the inlet fluid. As the pump piston is extended into the pump cylinder during the discharge or pumping stroke, the inlet poppet seats and discharge fluid pressure acting against the discharge poppet compresses the check valve spring by pulling attached poppet guide through the check valve seat and inlet poppet. This allows discharge flow between the discharge poppet and seat.

We prefer to provide a piston which extends between opposing cylinders having a housing therebetween. The housing contains means for reciprocating the piston. The piston can be of two piece construction connected by a spline or a single shaft having an offset center within the housing which offset engages the reciprocating means within the housing. Other objects and advantages of the invention will become apparent as a description of the present preferred embodiments proceeds.

DESCRIPTION OF THE PREFERRED EMBODIMENTS

Figure 1:
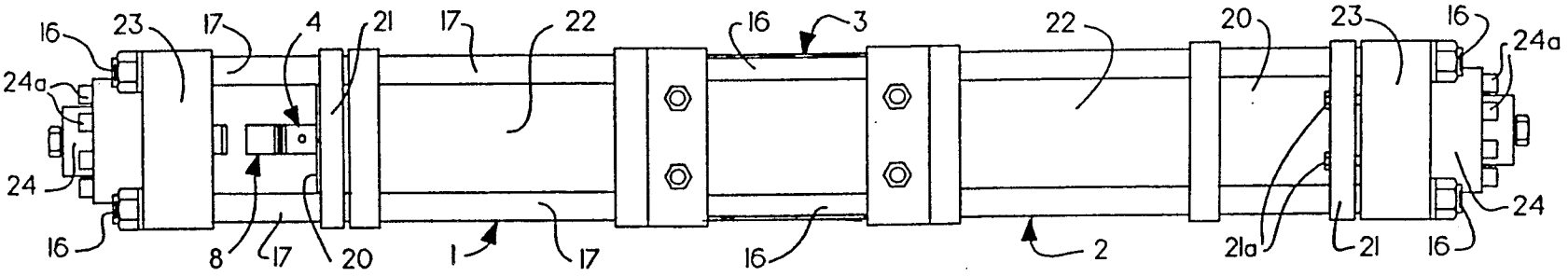
FIG. 1 is an elevational view of a present preferred embodiment of our pump.
Figure 2:
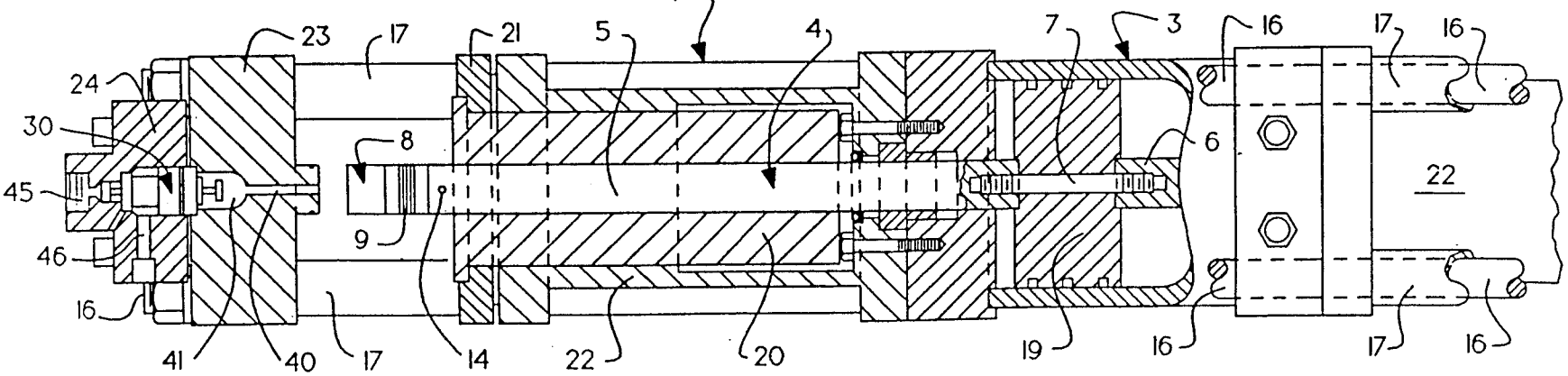
FIG. 2 is a longitudinal sectional view of the left hand portion of the pump of FIG. 1.
Figure 3:
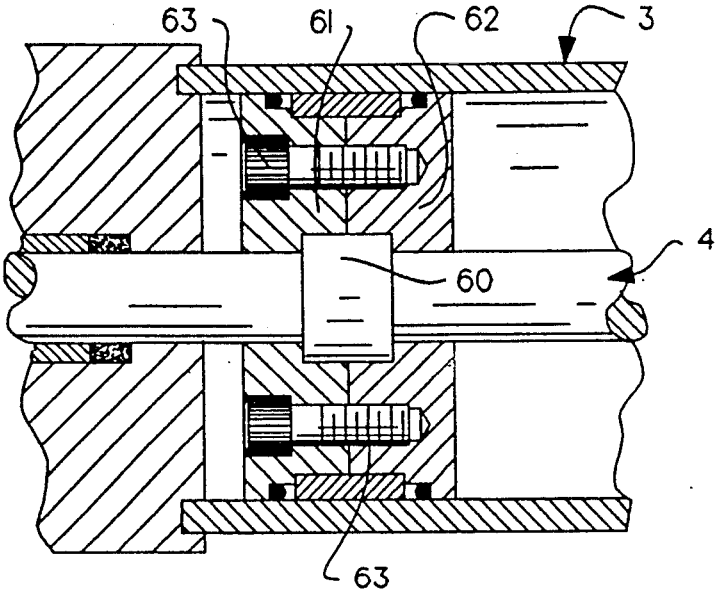
FIG. 3 is an enlarged, fragmentary, cross-sectional view of a second preferred piston construction.

As shown in FIG. 1, we provide a pump having two cylinder portions 1 and 2 separated by a housing portion 3 which contains means for reciprocating a piston which extends from cylinder 1 through the housing into cylinder 2. Tie-rods 16, passing through tubes 17 or spacers between the end flanges 23 and housing 3, hold the housing together and resist the load of the high pressure acting on the end flange. Cylinders 1 and 2 are substantially identical. A piston 4 reciprocates within cylinders 1 and 2. In the embodiment of FIGS. 1 and 2, the piston has two main body portions 5 and 6 connected by a central shaft 7. This shaft not only connects the body parts 5 and 6, but also carries a drive piston 19 which is moved by hydraulic fluid acting on either side of the piston 19 in a conventional manner. Alternatively, as shown in FIG. 3 the piston 4 may be of one piece construction. In both embodiments body portions 5 and 6 of the piston 4 must be in alignment. The single piece construction of FIG. 3 avoids any misalignment problems. In this embodiment the piston is a solid shaft having a central collar 60. We provide a two piece drive piston comprised of halves 61 and 62 connected by screws 63. This drive piston is acted upon by hydraulic fluid to cause the drive piston and attached shaft to reciprocate.

Figure 4:
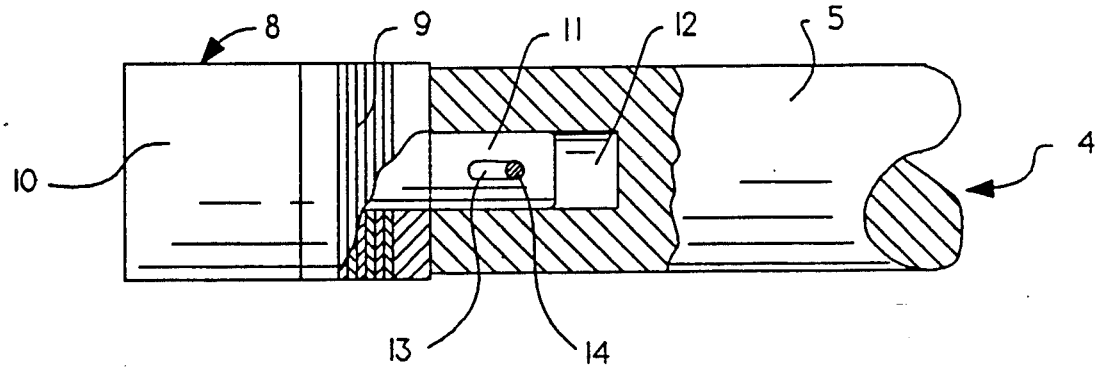
FIG. 4 is an enlarged view, partially in section, of one end of our piston.

Each end of the piston 4 is provided with a cap 8 which fits into main body portion 5 and holds packing 9. A preferred configuration for the end cap is more clearly shown in FIG. 4. End cap 8 has a head portion 10 and a stub shaft 11 extending therefrom. The stub shaft fits within a bore 12 in the main body 5. Also, the stub shaft is provided with a slot 13. Pin 14 extends through the main body 5 and passes through slot 13. The slot 13, stub shaft 11 and bore 12 in the main body 5 are sized to allow the cap 8 to move relative to the main body 5. As the packing material 9 wears, the cap portion 8 can move into the main body portion 5 compressing the packing material and maintaining a good seal.

The cylinder through which piston 4 reciprocates is comprised of an end cylinder 20 having a collar 21 and a housing cylinder 22 which is connected to the housing 3. The end cylinder 20 is sized to fit and telescope into the housing cylinder 22. In FIG. 2 we show the end cylinder 20 in a retracted position on the left hand cylinder portion 1. When the cylinder is closed, end cylinder 20 is connected to end flange 23 by screws 21*a*. The screws need only be strong enough to support the weight of the end cylinder 20. When the end cylinder 20 is telescoped into the housing cylinder 22 the head 8, the piston body 5 and the self energizing packing 9 are exposed. A pin 14 in a main body 5 of the piston 4 is removed allowing one to remove the end cap 8 and the packing material 9. New packing material can be placed on the stub shaft 13. Then cap 8 is placed on the piston 4 and pin 14 is inserted. Finally, end cylinder 20 is returned to a closed position. We prefer to make the end cylinder 20 long enough so that the end portion of the piston remains within the end cylinder throughout its reciprocating stroke. Since the pump is designed with a straight circular bore, end cylinder 20 is easily held to the end flange 23 with small screws sized only to accommodate the weight of the end barrel 20 and friction of the piston on the suction stroke.

Figure 8:
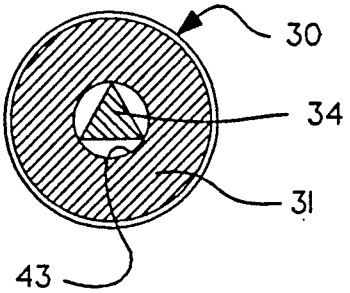
FIG. 8 is a cross sectional view taken along the line VIII—VIII of FIG. 5.

Within the end portion 24 held to end flange 23 by screws 24*a* there is a passageway 40 which leads to check valve 30. The operation of this check valve can be better understood with reference to FIGS. 5, 6, 7 and 8. The check valve 30 has a main body 31 through which a central passageway 43 is bored. Poppet guide 32 is fitted within the passageway 43. The guide has a main body 34 which is preferably triangular in configuration to permit fluid to flow about the body. Other cross-sectional shapes such as diamond or pentagon will also work as long as the body is seated against the wall of passageway 34 as shown in FIG. 8 thereby preventing transverse movement or vibration. The outer end of the guide terminates in a nut 32. Inlet poppet 33 is provided on the guide near the nut 32. A compression spring 38 is provided around the guide 32 to bias the poppet 33 and poppet 35 attached to the opposite end of guide 32 toward the main body 31 closing the inlet and discharge check valves when no pressure acts on the poppets. FIG. 7 shows the check valve in this state of rest.

Figure 5:
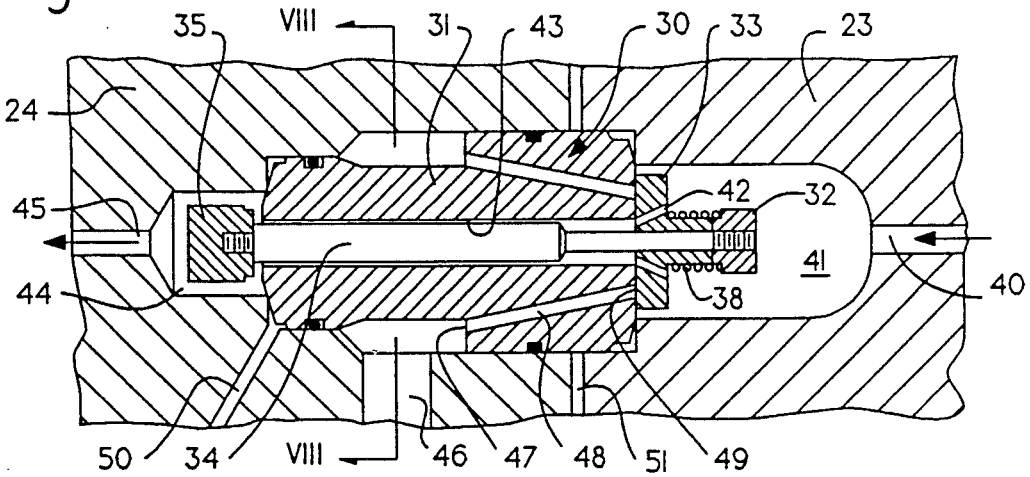
FIG. 5 is a cross sectional view of our check valve with the poppet positioned to permit flow in a first direction.

FIG. 5 shows the discharge operation of check valve 30. Fluid enters passageway 40 from the pump cylinder and flows through passageways 42 into the central passageway 43 of the check valve body 31. Flow of the fluid pushes against poppet 35 moving this poppet and guide 32 away from check valve 31 and further compressing spring 38 and maintaining poppet 33 against the body 31 sealing passageway 48. As poppet 35 is forced away from the check valve body 31, fluid can flow into chamber 44 and then out through pump discharge passageway 45. Alignment of the check valve poppets 33 and 35 with passageway 43 is accomplished with guide 32 while allowing random seating orientation.

Figure 6:
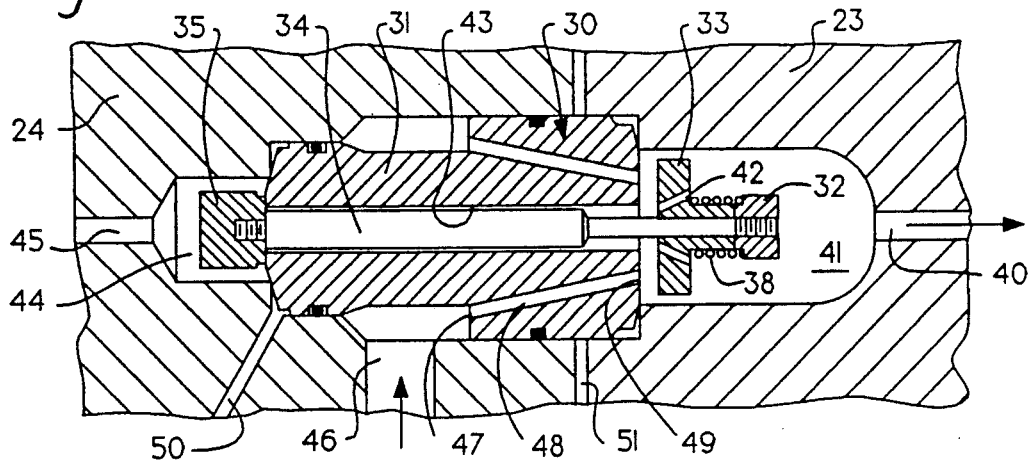
FIG. 6 is a cross sectional view of the check valve with the poppet positioned to permit flow in a second direction.
Figure 7:
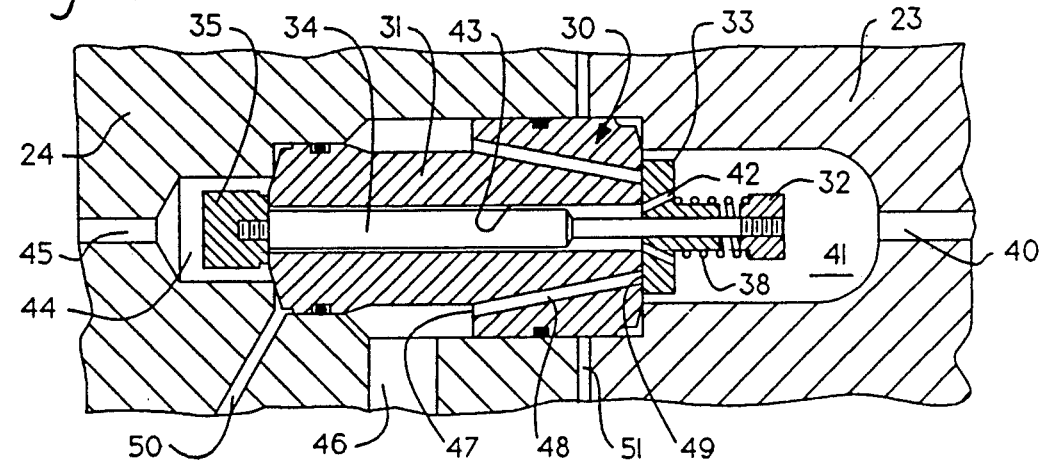
FIG. 7 is a cross sectional view of our check valve in a rest position.

The intake operation of the check valve 30 ca be seen in FIG. 6. Fluid enters through passageway 46 and flows to inlet 47 through channel 48 to outlet 49. Outlet 49 is near central bore 43 and covered by poppet 33. Flow of the fluid pushes against poppet 33 moving the poppet toward the passageway 40. Poppet 35 is seated against the housing 31 sealing passageway 43. As the poppet is forced away from the main body portion, fluid can flow into chamber 41 then through passageway 40 into the main cylinder portion of barrel 20. Because none of the passageways of check valve 30 form a T-intersection, this valve works well under high pressure and has a long service life. We further prefer to provide passageways 50 and 51 which would direct any leakage from the check valve through end portion 24 away from the pump. A drop of fluid near the exits of these passageways would indicate leakage. Without these passageways, leaks would pass into the adjacent chamber and would not be detected until significant leakage had occurred.

Our pump can be sealed when in the operating mode. Consequently, venting or flushing can safely be done when pumping fluids which are toxic, flammable or that harden when exposed to air.

While we have shown certain present preferred embodiments of our invention, it should be understood that the invention is not limited thereto but may be variously embodied within the scope of the following claims.

We claim:

1. An improved pump of the type having a piston having one end extending into a cylinder and a packing attached to the end, an end flange having a passageway therethrough and attached to the cylinder and means for reciprocating the piston toward and away from the end flange, a housing containing the means for reciprocating the piston, and tie rods connecting the end flange, cylinder and the housing together wherein the improvement comprises a telescoping cylinder having:

(a) a housing cylinder attached to the housing, the housing cylinder having a length such that when the piston is fully extended toward the end flange, the packing on the piston will be beyond the housing cylinder, and (b) an end cylinder removably attached at one end to the end flange having a central bore through which the piston reciprocates and having an opposite end which fits into the housing cylinder, the end cylinder being sized so that when disconnected from the end flange, the end cylinder can be telescoped into the housing cylinder to expose the packing.

2. The improved pump of claim 1 wherein the piston is comprised of:

(a) a main body of a selected diameter having a bore at one end;

(b) a cap having ahead and a stub shaft having a transverse slot, the stub shaft fitted into the bore of the main body, the bore of the main body and the transverse slot in the stub shaft being sized to permit the cap to move relative to the main body;

(c) a pin passing through the main body and the transverse slot in the stub shaft to hold the cap against the main body; and (d) packing material fitted onto the stub shaft between the cap head and the main body.

3. The improved pump of claim 1 also comprising a check valve connected to the passageway in the end flange, the check valve comprised of (a) a housing having a central bore of selected diameter passing therethrough, at least one inlet channel running through the housing from an inlet port to an outlet port adjacent the central bore;

(b) a poppet guide having a body portion extending through the central bore and sized to permit fluid to flow through the bore, a poppet at one end of the guide and a retainer at an opposite end of the guide, and (c) a poppet assembly attached to the poppet guide sized and positioned to abut the housing and when there positioned to seal the inlet channel and having a port therethrough to permit fluid to flow through the poppet into the central bore when the poppet abuts the housing.

4. The improved pump of claim 3 wherein the poppet is slidably attached to the guide and also comprising a spring on the poppet guide positioned to bias the poppet toward the housing.

5. The improved pump of claim 3 wherein the poppet is slidably attached to the poppet guide and also comprising a spring on the guide sized and positioned to bias the first poppet and the retainer to seated positions.

6. The improved pump of claim 3 wherein the end flange contains at least one passageway to the check valve through which fluid will flow when the check valve leaks from the check valve to an exterior point on the end flange.

7. An improved pump of the type having a piston which reciprocates through two cylinders having a housing therebetween and an end flange for each cylinder, each end flange having a passageway therethrough and tie rods passing through spacer tubes holding the housing cylinders and end flanges together wherein the improvement causes telescoping cylinders, each cylinder comprised of:

(a) a housing cylinder attached to the housing and the housing cylinder having a length such that when the piston is fully extended toward the end flange, the packing on the piston will be beyond the housing cylinder, and (b) an end cylinder removably attached at one end to the end flange having a central bore through which the piston reciprocates and having an opposite end which fits into the housing cylinder, the end cylinder being sized so that when disconnected from the end flange, the end cylinder can be telescoped into the housing cylinder to expose the packing.

8. The improved pump of claim 7 wherein the piston is comprised of:

(a) a main body of a selected diameter having a bore at one end;

(b) a cap having a head and a stub shaft having a transverse slot, the stub shaft fitted into the bore of the main body, the bore of the main body and the transverse slot in the stub shaft being sized to permit the cap to move relative to the main body;

(c) a pin passing through the main body and the transverse slot in the stub shaft to hold the cap against the main body; and (d) packing material fitted onto the stub shaft between the cap head and the main body.

9. The improved pump of claim 7 also comprising a check valve connected to the passageway in the end flange, the check valve comprised of (a) a housing having a central bore of selected diameter passing therethrough, at least one inlet channel running through the housing from an inlet port to an outlet port adjacent the central bore;

(b) a poppet guide having a body portion extending through the central bore and sized to permit fluid to flow through the bore, a poppet at one end of the guide and a retainer at an opposite end of the guide, and (c) a popper slidably attached to the poppet guide sized and positioned to abut the housing and when there positioned to seal the inlet channel and having a port therethrough to permit fluid to flow through the poppet into the central bore when the poppet abuts the housing.

10. The improved pump of claim 9 wherein the poppet is slidably attached to the poppet guide and also comprising a spring on the body positioned to bias the poppet toward the housing.

11. The improved pump of claim 9 wherein the poppet is slidably attached to the poppet guide and also comprising a spring on the guide sized and positioned to bias the first poppet and the retainer to seated positions.

12. The improved pump of claim 9 wherein the end flange contains at least one passageway to the check valve through which fluid will flow when the check valve leaks from the check valve to an exterior point on the end flange.

13. The improved pump of claim 7 wherein the piston is comprised of:

(a) a first main body portion which extends into the cylinder, (b) a second main body portion which extends into a second cylinder;

(c) a drive piston positioned in the housing; and (d) a shaft passing through the drive piston and connecting the first and second main body portions to the drive piston.

14. The improved pump of claim 7 wherein the piston is comprised of:

(a) a shaft passing through both cylinders and the housing; and (b) a drive piston attached to the shaft and positioned within the housing.

15. The improved pump of claim 14 wherein the shaft has a collar about which the drive piston fits and the drive piston is comprised of two halves connected together.

* * * * *

UNITED STATES PATENT AND TRADEMARK OFFICE

CERTIFICATE OF CORRECTION

PATENT NO. : 5,064,354

DATED : November 12, 1991

INVENTOR(S) : WALTER ROBERTSON, JASON ROBERTSON

It is certified that error appears in the above-identified patent and that said Letters Patent is hereby corrected as shown below:

Column 4, line 41, change "ca" to --can--.

Column 6, line 48, claim 9, change "popper" to --poppet--.

Signed and Sealed this

Ninth Day of March, 1993

*Attest:*

STEPHEN G. KUNIN

*Attesting Officer*

*Acting Commissioner of Patents and Trademarks*